US006450859B1

(12) United States Patent
Moyer

(10) Patent No.: US 6,450,859 B1
(45) Date of Patent: Sep. 17, 2002

(54) METHOD AND APPARATUS FOR ABRADING A SUBSTRATE

(75) Inventor: Thomas P. Moyer, Lagrangeville, NY (US)

(73) Assignee: International Business Machines Corporation, Armonk, NY (US)

( * ) Notice: Subject to any disclaimer, the term of this patent is extended or adjusted under 35 U.S.C. 154(b) by 36 days.

(21) Appl. No.: 09/675,245

(22) Filed: Sep. 29, 2000

(51) Int. Cl.[7] ..... B24B 1/00

(52) U.S. Cl. ..... 451/5; 456/6; 456/41; 456/291; 456/294; 409/187

(58) Field of Search ..... 451/516, 41, 285–289, 451/7–10, 291, 294; 356/601, 602, 614, 237.1–5, 622–623, 630–631; 409/131, 132, 187, 194; 408/16

(56) References Cited

U.S. PATENT DOCUMENTS 4,834,655 A * 5/1989 Kyotani ..... 433/166
5,310,341 A * 5/1994 Byer ..... 433/116
5,439,551 A * 8/1995 Meikle et al. ..... 451/41
5,643,044 A * 7/1997 Lund ..... 451/5
5,644,221 A 7/1997 Li et al.
5,899,798 A 5/1999 Trojan et al.
6,159,073 A * 12/2000 Wiswesser et al. ..... 451/6
6,179,690 B1 * 1/2001 Talieh ..... 451/41
6,305,935 B1 * 10/2001 Cardarelli ..... 433/126
6,307,628 B1 * 10/2001 Lu et al. ..... 356/382

* cited by examiner

*Primary Examiner*—George Nguyen
(74) *Attorney, Agent, or Firm*—Ira D. Blecker

(57) ABSTRACT

An apparatus for abrading a substrate including a moveable abrading tool having a bur for abrading the substrate, a stage for supporting the substrate, and a height sensing device in communication with the abrading tool to determine a vertical position of the bur with respect to the substrate. Further disclosed is a method for abrading a substrate using the foregoing apparatus including moving the abrading tool across the substrate so as to abrade the substrate, determining the vertical position of the bur with the height sensing device, and communicating the vertical position of the bur to the abrading tool.

35 Claims, 3 Drawing Sheets

METHOD AND APPARATUS FOR ABRADING A SUBSTRATE

BACKGROUND OF THE INVENTION

The present invention relates to the abrading of substrates and, more particularly, relates to the abrading of ceramic and semiconductor substrates using a small, computer-controlled abrading tool.

Ceramic substrates comprising ceramic material and metallization, useful for mounting semiconductor devices, often become nonplanar after sintering due to an uneven distribution of metal and ceramic materials within the ceramic substrate. Ceramic substrates useful for thin films require a planar ceramic substrate so any nonplanarity in the ceramic substrate is removed through polishing of the ceramic substrates. Polishing is typically accomplished by placing the ceramic substrates on a large polishing table wherein a slurry containing an abrasive grit is used as the abrasive medium.

As part of the manufacturing process of semiconductor devices, semiconductor wafers are polished by a chemical mechanical polishing (CMP) process, one example of which is disclosed in Trojan et al. U.S. Pat. No. 5,899,798, the disclosure of which is incorporated by reference herein. The uniform removal of material from and the planarity of patterned and unpatterned wafers is critical to wafer process yield. Generally, the wafer to be polished is mounted on a substrate carrier which holds the wafer using a combination of vacuum suction or other means to contact the rear side of the wafer and a retaining lip or ring around the edge of the wafer to keep the wafer centered on the substrate carrier. The front side of the wafer, the side to be polished, is then contacted with a chemically reactive slurry.

The amount of material removal is more critical in the planarizing of semiconductor wafers than ceramic substrates. Overpolishing (removing too much) or underpolishing (removing too little) of the wafer results in scrapping or rework of the wafer, respectively, which can be very expensive. To remedy this problem, a number of endpoint detect methods have been devised to detect when the desired endpoint for removal has been reached, and the polishing can be stopped. One such method for endpoint detect in a CMP process is disclosed in Li et al. U.S. Pat. 5,644,221, the disclosure of which is incorporated by reference herein.

While the above methods for planarization work well enough, the present invention takes a new approach to planarization of ceramic substrates and semiconductor wafers. Instead of large polishing pads or surfaces which planarize the entire ceramic substrate or semiconductor wafer at the same time, it would be desirable to have a method and apparatus for planarizing a small portion of the ceramic substrate or semiconductor wafer at any given time. This would allow greater versatility in the process, particularly if only small portions of the ceramic substrate or semiconductor wafer need to be abraded or otherwise require material removal.

Accordingly, it is a purpose of the present invention to have a method and apparatus for abrading a small portion of the ceramic substrate or semiconductor wafer at any given time.

It is another purpose of the present invention to have a method and process for abrading a ceramic substrate or semiconductor wafer which is versatile in use.

These and other purposes of the present invention will become more apparent after referring to the following description of the invention considered in conjunction with the accompanying drawings.

BRIEF SUMMARY OF THE INVENTION

The purposes of the invention have been achieved by providing, according to a first aspect of the invention, an apparatus for abrading a substrate comprising:

a moveable abrading tool having at least one bur for abrading the substrate;

a stage for supporting the substrate; and at least one height sensing device in communication with the abrading tool to determine a vertical position of the at least one bur with respect to the substrate.

According to a second aspect of the invention there is provided an apparatus for abraiding a substrate comprising:

a moveable,pneumatically-powered abraiding the substrate;

a stage for supporting the substrate; and at least one laser intterferometer in communication with the abraiding tool to determine a vertical position of the at least one bur with respect to the substrate.

According to a third aspect of the invention there is provided an apparatus for abrading a substrate with an apparatus comprising a moveable abrading tool having at least one bur for abrading the substrate, a stage for supporting the substrate, and at least one height sensing device in communication with the abrading tool to determine a vertical position of the at least one bur with respect to the substrate, the method comprising the steps of:

moving the abrading tool across the substrate so as to abrade the substrate;

determining the vertical position of the at least one bur with the at least one height sensing device; and communicating the vertical position of the at least one bur to the abrading tool.

BRIEF DESCRIPTION OF THE DRAWINGS

The features of the invention believed to be novel and the elements characteristic of the invention are set forth with particularity in the appended claims. The Figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1:
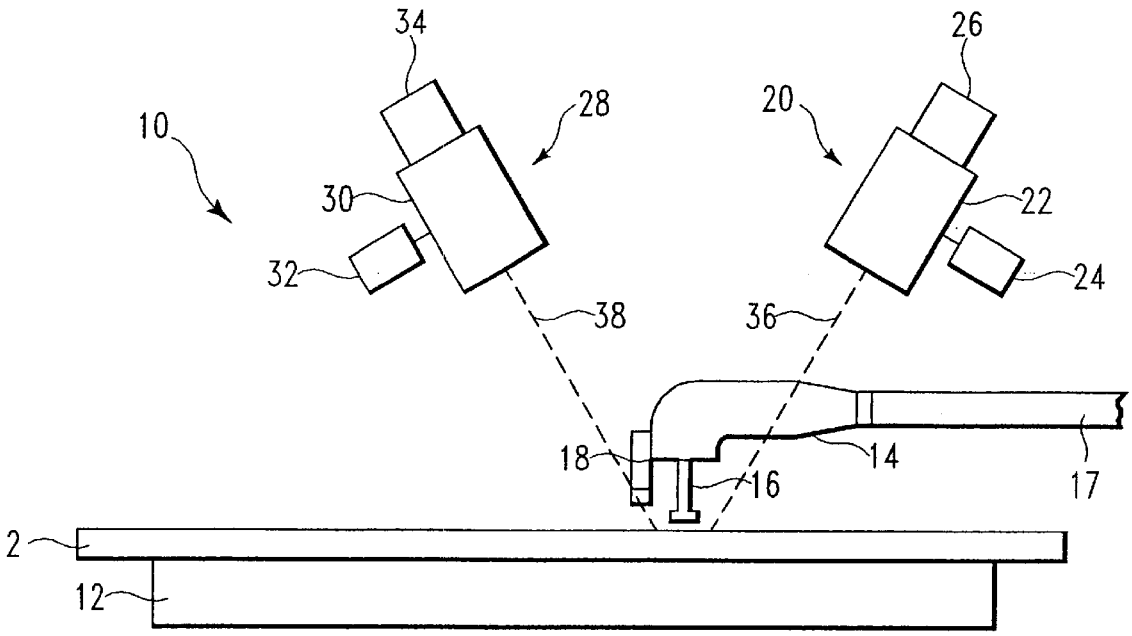
FIG. 1 is an schematical view of the apparatus for abrading a substrate according to the present invention in which a bur is used to abrade the substrate.

Referring to the Figures in more detail, and particularly referring to FIG. 1, there is shown a substrate 2 to be abraded, and more preferably, planarized. Substrate 2 may be a semiconductor wafer, a ceramic substrate or other similar article, which collectively hereafter will be referred to as simply a substrate.

Apparatus 10 will be used to abrade all or part of substrate 2. Substrate 2 is placed on stage 12 which can move or remain stationary. Abrading tool 14 has a bur 16 for abrading the substrate. Abrading tool 14 is moveable in the x, y or z directions as well as moveable to make circular, spiral or other patterns on the substrate 2. As will be understood by those skilled in the art, abrading tool 14 will be connected to additional mechanical or electromechanical apparatus (not shown) through arm 17 which will move the abrading tool 14 in the desired pattern.

Apparatus 10 further comprises at least one height sensing device 20 in communication with the abrading tool 14. The at least one height sensing device determines the vertical position of the bur 16 with respect to the substrate 2. There may be additional height sensing devices such as height sensing device 28.

In operation, abrading tool 14 and bur 16 move across substrate 2. The movement of the abrading tool 14 and bur 16 are controlled by cooperation between arm 17 and stage 12. As noted above, stage 12 can be moveable or stationary. If desired, stage 12 can move in the x, y or z directions, can rotate or can move in some combination of the foregoing. As can be appreciated, the movements resulting from the cooperation of stage 12 and arm 17 are practically infinite in nature. The vertical location of bur 16 is controlled by arm 17 or stage 12 or both in conjunction with height sensing device 20 and/or height sensing device 28. The height sensing device or devices determines the vertical position of the bur 16 with respect to the substrate 2. As can be seen in FIG. 1, height sensing device 20 is focused 36 behind bur 16 while height sensing device 28 is focused 38 in front of bur 16. This information is relayed to arm 17 directly or through an intermediary device such as a tool controller or computer. If stage 12 is moveable, the position information may also be relayed to stage 12. Thereafter, arm 17 and/or stage 12 move so that bur 16 is in the correct location for abrading. The depth of cut for semiconductor wafers will tend to be shallow, on the order of several microns or less, while the depth of cut for ceramic would probably be much larger.

As noted above, apparatus 10 can be used to abrade all or part of substrate 2. If a completely planarized substrate 2 is desired, apparatus 10 would abrade the entire substrate 2. In some situations, it may be desirable to abrade only a portion of substrate 2. As one example, apparatus 10 can be used to selectively expose areas of metallurgy for on-chip capacitors which could then be directly connected to a carrier by wirebond.

Figure 2:
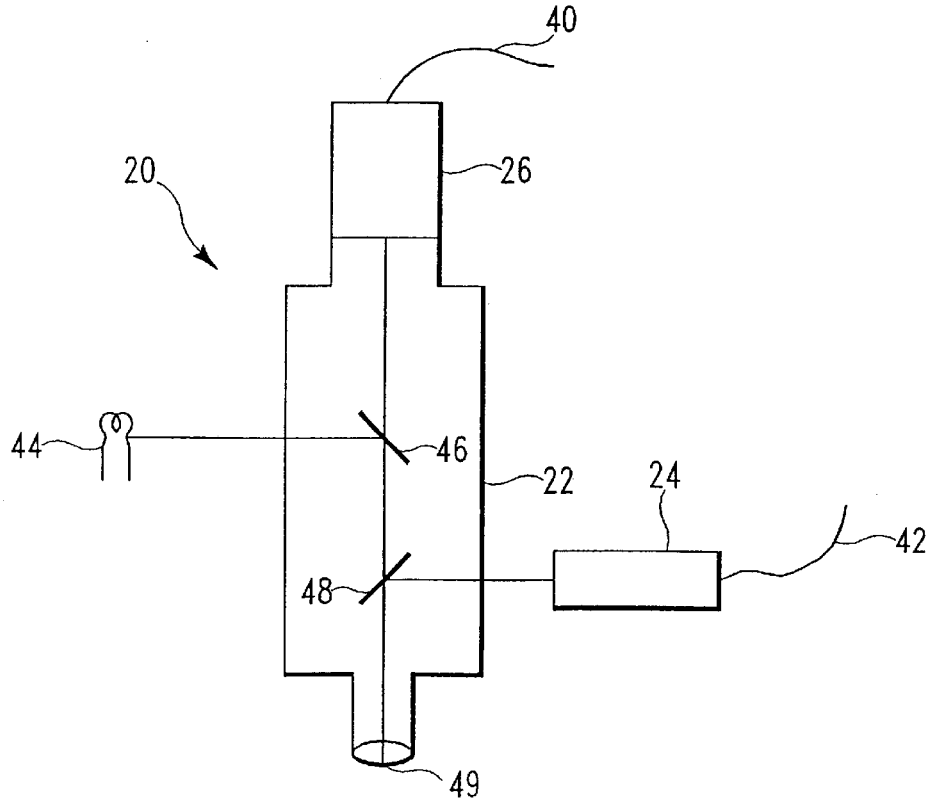
FIG. 2 is a schematical view of one device for measuring the height of the bur with respect to the substrate.

In one preferred embodiment of the present invention, it is preferred that the at least one height sensing device is a laser interferometer, such as one manufactured by Teletrac, Inc., Goleta, Calif. Referring now to FIG. 2, one such arrangement for a laser interferometer is shown. There, laser interferometer 24 cooperates with mirror 48 and optics 49 to direct its light in the desired direction. The laser light bounces off the substrate 2 and back through optics 49 and mirror 48 to laser interferometer 24. The height so determined is fed to arm 17 of abrading tool 14 through cable 42.

Figure 5A:
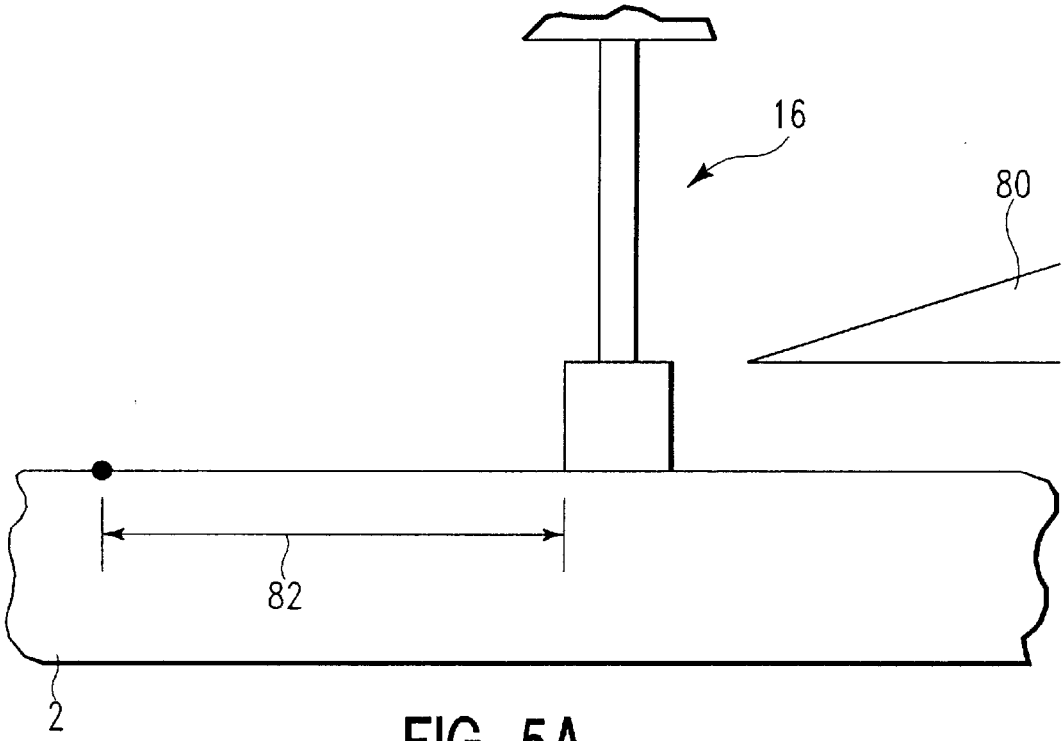
FIGS. 5A and 5B are schematical views of an alternative methodology for measuring the height of the bur with respect to the substrate.
Figure 5B:
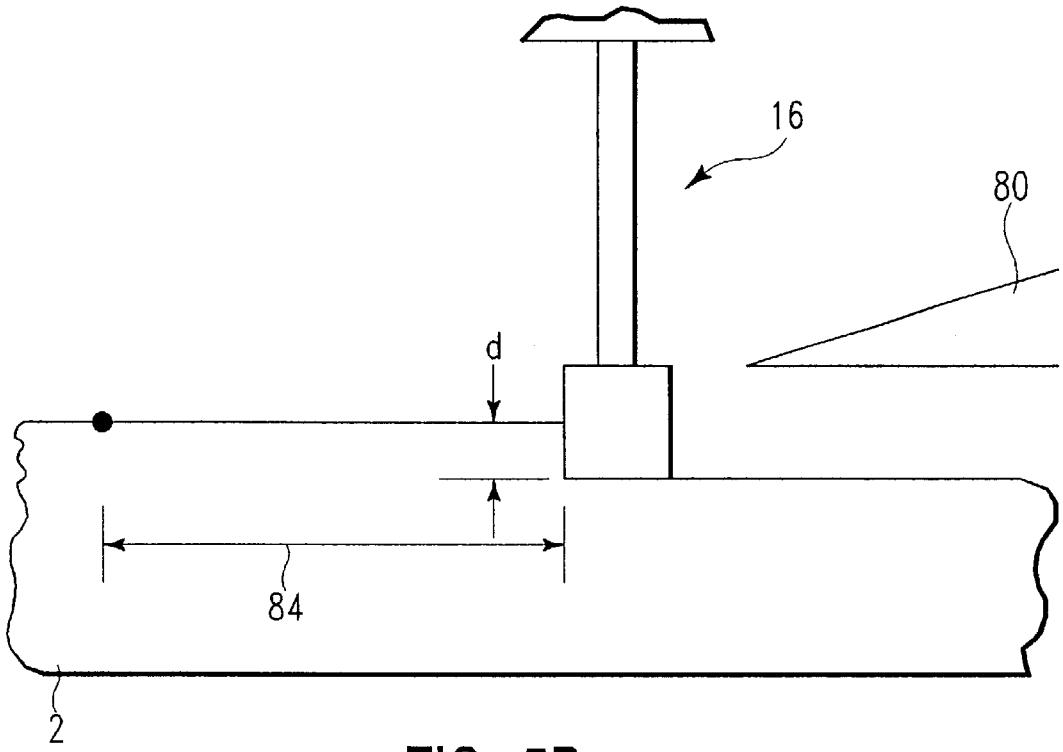

An alternative methodology for determining the vertical position of the bur 16 with respect to the substrate 2 is illustrated in Figures 5A and 5B. As shown in FIG. 5A, a suitable light source 80, preferably a laser, is shown upon bur 16. If necessary, light source 80 may be raster scanned in the vertical direction so all of bur 16 is illuminated. Once illuminated, bur 16 casts a shadow having a length 82. Subsequently, the shadow is measured after the bur 16 has abraded into the substrate 2. The distance 84 of the shadow after abrading has begun is compared to distance 82 prior to abrading. Knowing the length of bur 16, the distance "d", the depth of cut, can be accurately determined. While not shown in FIGS. 5A and 5B, a conventional image capture device such as a camera may be used to measure the length of the shadows 82, 84 and bur 16. The above methodology can also be utilized to determine when the bur 16 contacts substrate 12 by observing when the shadow meets bur 16.

While the Figures show one bur 16 it is within the scope of the present invention to have a plurality of burs 16 acting in unison. This may be accomplished by modifying abrading tool 14 so as to accept move than one bur 16. Alternatively, a plurality of abrading tools 14 may be provided, each one having a single bur 16. In this latter case, the plurality of abrading tools 14 would have to be linked mechanically, electrically or by software.

Returning to FIG. 1, the abrading apparatus 10 can further include a transducer 18 to audibly determine the load on the abrading tool 14. When the load on the abrading tool 10 is increased, that is, the bur 16 is meeting increased resistance from the substrate 2, the sound of the abrading tool will audibly change, which is picked up by the transducer 18. In a preferred embodiment, transducer 18 is a microphone. This information is relayed back to the abrading tool 14 to speed up or slow down the movement of the abrading tool 14.

Figure 3:
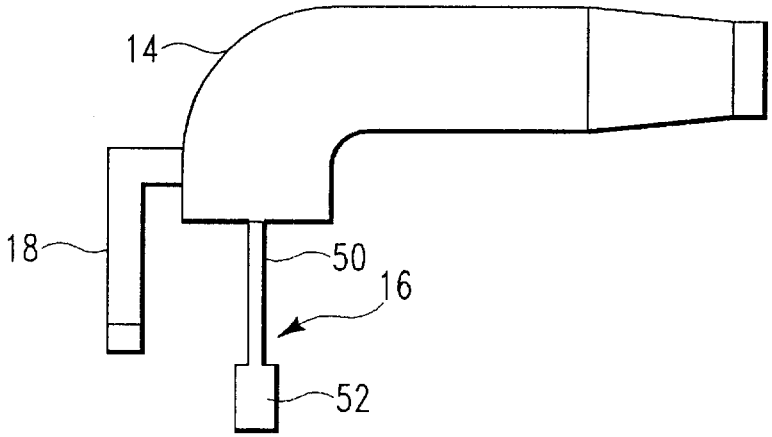
FIG. 3 is an enlarged view of a tool used for abrading the substrate.

Turning now to FIG. 3, an enlarged view of the abrading tool 14 is shown with transducer 18 appended off of abrading tool 14. Bur 16 has a shaft 50 which is held by abrading tool 14 and abrasive end 52. The abrasives of abrasive end 52 are preferably diamonds. One preferred abrading tool 14 is a so-called dental handpiece, available from Star Dental (Lancaster, Pa.). The dental handpiece is essentially a pneumatically powered turbine capable of speeds in the neighborhood of 300–500 thousand revolutions per minute. The high RPMs of the dental handpiece lead to a very efficient abrading tool. The dental handpiece would of course have to be suitably modified with arm 17 so that the movement of the dental handpiece can be automated and computer controlled if desired. The burs are commonly available from a number of manufacturers, one of which is Carlisle Labs (England). The burs have a diameter of about 1 mm.

Apparatus 10 may further include an image viewer to view the substrate 2 where it has just been abraded. The substrate 2 can be continually monitored for changes in surface features. For example, if one were looking to abrade the surface of the substrate 2 until a metal feature is uncovered, the image viewer could sample the surface until a reflective or shiny surface is located. In this manner, the image viewer functions as an endpoint detect system. Preferably, the image viewer is a camera.

The image viewer may be located in the same apparatus that holds the height sensing device 20. Referring to FIG. 2, body 22 is essentially a microscope which is connected to both the laser interferometer 24 and camera 26. A separate light source 44 and mirror 46 are provided to illuminate the surface of the substrate 2 and provide reflected light back to camera 26. Data from camera 26 is transmitted through cable 40. Height sensing device 28 may be similar to height sensing device 20 in that it could also contain a microscope body 30, laser interferometer 32 and camera 34. Camera 34 could be used for the alternative height sensing methodology mentioned with respect to FIGS. 5A and 5B.

Figure 4:
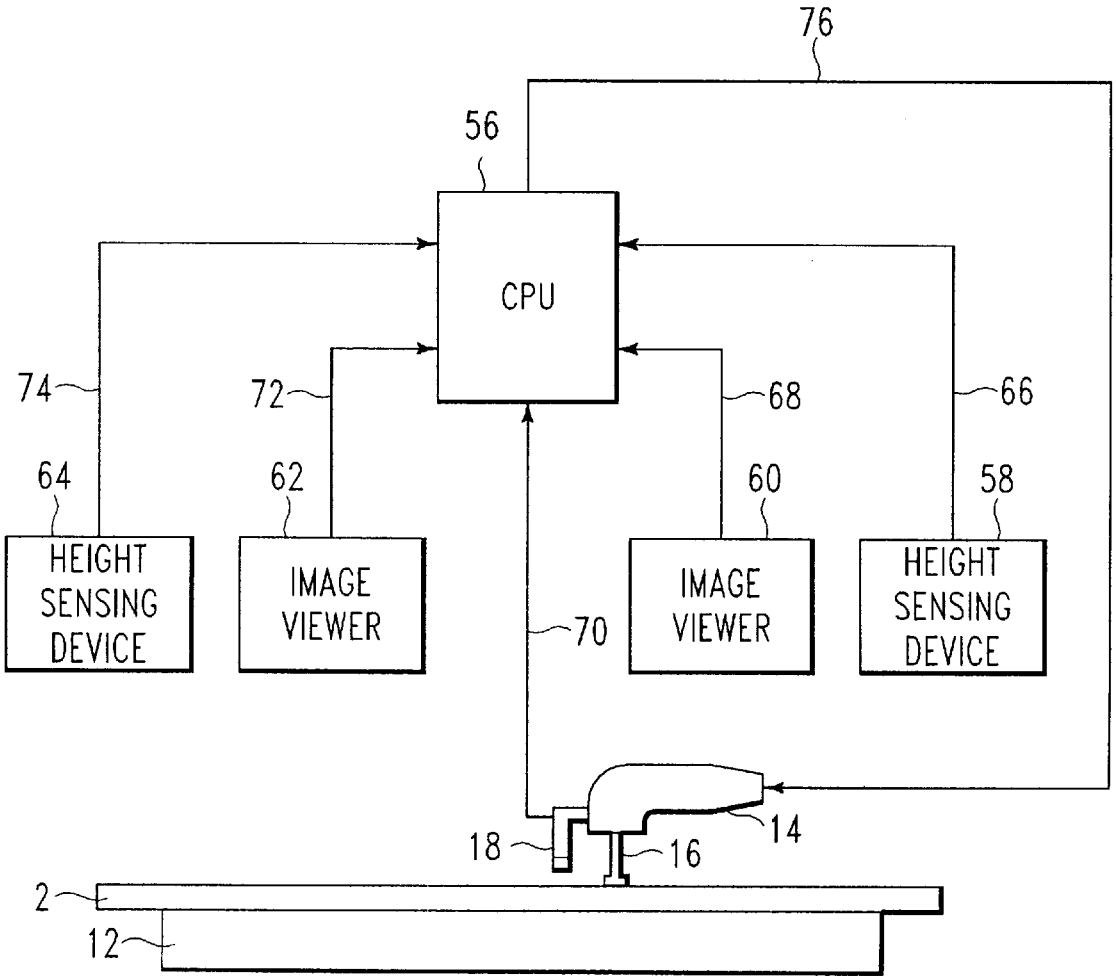
FIG. 4 is a block diagram which shows the general layout and feedback CPU of the abrading apparatus according to the present invention.

In a preferred embodiment of the invention, there is provided a feedback means as shown in FIG. 4 which is used to monitor and control the abrading tool 14. Ideally, the feedback means would sample the apparatus 10 and provide appropriate feedback to the abrading tool 14 on the order of 25–30 times per second. It should be understood that some or all of the components shown in FIG. 4 may be part of the apparatus 10 as explained previously. Height sensing devices 58, 64 provide their data to Central Processing Unit (CPU) 56 via cables 66, 74, respectively. The CPU 56 processes the data and determines whether the bur 16 is at the right vertical position with respect to the substrate 12. If not, CPU 56 communicates by cable 76 to abrading tool 14 and/or stage 12 to bring bur 16 to the right vertical position.

Transducer 18 provides its data to CPU 56 via cable 70. If the sound of abrading tool sounds right, no action is taken. Otherwise, CPU 56 through cable 76, stage 12 and/or arm 17 causes the movement of abrading tool 14 to speed up or slow down with respect to the substrate 12, as appropriate.

Image viewers 60, 62 provide their data to CPU 56 via cables 68, 72, respectively. Recall that image viewers 60, 62 may be used for endpoint detect or for determining the vertical position of the bur 16. For example, image viewer 60 may be used for endpoint detect while image viewer 62 may be used to determine the vertical position of the bur 16 with respect to the substrate 12. Once CPU 56 processes the data from image viewers 60, 62, the CPU 56 signals appropriate action over cable 76 to abrading tool 14 and/or stage 12.

Lastly, CPU 56 may be part of a computer, a part of another device, or a stand alone tool controller.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. An apparatus for abrading a substrate comprising:

a moveable abrading tool having at least one bur for abrading the substrate;

a stage for supporting the substrate, at least one of the abrading tool and stage being moveable in a vertical direction; and at least one height sensing device in communication with the abrading tool to determine a vertical position of the at least one bur with respect to the substrate.

2. The apparatus of claim 1 further comprising feedback means for receiving data from the at least one height sensing device, evaluating such data and regulating at least the vertical movement of the abrading tool in response to such data.

3. The apparatus of claim 1 further comprising a transducer to audibly determine a load on the abrading tool.

4. The apparatus of claim 3 further comprising feedback means for receiving data from the at least one height sensing device and transducer, evaluating such data and regulating at least the vertical movement of the abrading tool in response to such data.

5. The apparatus of claim 1 further comprising an image viewer to view the substrate where it has been abraded by the at least one bur.

6. The apparatus of claim 5 further comprising feedback means for receiving data from the at least one height sensing device and the image viewer, evaluating such data and regulating at least the vertical movement of the abrading tool in response to such data.

7. The apparatus of claim 1 wherein the abrading tool is a dentist tool.

8. The apparatus of claim 1 wherein the at least one height sensing device is a laser interferometer.

9. The apparatus of claim 3 wherein the transducer is a microphone.

10. The apparatus of claim 5 wherein the image viewer is a camera.

11. The apparatus of claim 1 wherein there are a plurality of burs and the plurality of burs move in unison.

12. The apparatus of claim 1 wherein there are a plurality of height sensing devices, at least one of which determines the vertical position of the bur just in front of the bur and at least one of which determines the vertical position of the bur just behind the bur.

13. The apparatus of claim 1 wherein the substrate is a semiconductor wafer or a ceramic substrate.

14. The apparatus of claim 1 wherein the at least one bur has a diameter of about 1 mm.

15. The apparatus of claim 1 wherein the abrading tool is pneumatically powered.

16. The apparatus of claim 1 wherein the stage can move in the x, y or z direction.

17. The apparatus of claim 1 wherein the stage can rotate.

18. An apparatus for abrading a substrate comprising:

a moveable, pneumatically-powered abrading tool having at least one bur for abrading the substrate;

a stage for supporting the substrate, at least one of the abrading tool and stage being moveable in a vertical direction; and at least one laser interferometer in communication with the abrading tool to determine a vertical position of the at Ieast one bur with respect to the substrate.

19. The apparatus of claim 18 further comprising a feedback CPU for receiving data from the at least one laser interferometer, evaluating such data and regulating at least the vertical movement of the abrading tool in response to such data.

20. The apparatus of claim 18 further comprising a microphone to audibly determine a load on the abrading tool.

21. The apparatus of claim 20 further comprising a feedback CPU for receiving data from the at least one laser interferometer and microphone, evaluating such data and regulating at least the vertical movement of the abrading tool in response to such data.

22. The apparatus of claim 18 further comprising an image viewer to view the substrate where it has just been abraded by the at least one bur.

23. The apparatus of claim 22 further comprising a feedback CPU for receiving data from the at least one laser interferometer and the image viewer, evaluating such data and regulating at least the vertical movement of the abrading tool in response to such data.

24. The apparatus of claim 18 wherein the abrading tool is a dentist tool.

25. The apparatus of claim 22 wherein the image viewer is a camera.

26. The apparatus of claim 18 wherein there are a plurality of burs and the plurality of burs move in unison.

27. The apparatus of claim 18 wherein there are a plurality of laser interferometers, at least one of which determines the vertical position of the bur just in front of the bur and at least one of which determines the vertical position of the bur just behind the bur.

28. The apparatus of claim 18 wherein the substrate is a semiconductor wafer or a ceramic substrate.

29. The apparatus of claim 18 wherein the at least one bur has a diameter of about 1 mm.

30. The apparatus of claim 18 wherein the stage can move in the x, y or z direction.

31. The apparatus of claim 18 wherein the stage can rotate.

32. A method for abrading a substrate with an apparatus comprising a moveable abrading tool having at least one bur for abrading the substrate, a stage for supporting the substrate, and at least one height sensing device in communication with the abrading tool to determine a vertical position of the at least one bur with respect to the substrate, the method comprising the steps of:

moving the abrading tool across the substrate so as to abrade the substrate;

determining the vertical position of the at least one bur with the at least one height sensing device;

communicating the vertical position of the at least one bur to the abrading tool; and regulating at least the vertical movement of the abrading tool in response to the determination of the vertical position of the at least one bur.

33. The method of claim 32 wherein the apparatus further comprises a sound transducer and a feedback CPU and wherein the method further comprises the steps of:

audibly determining a load on the abrading tool;

communicating the audible determination of the load and the vertical position of the at least one bur to the feedback CPU;

evaluating such audible determination and vertical position by the feedback CPU; and regulating at least the vertical movement of the abrading tool in response to the evaluation of such audible determination and vertical position.

34. The method of claim 32 wherein the apparatus further comprises a sound transducer, an image viewer and a feedback CPU, and wherein the method further comprises the steps of:

audibly determining a load on the abrading tool;

capturing a view of the substrate through the image viewer where the substrate has just been abraded;

communicating the audible determination of the load, the vertical position of the at least one bur, and the view of the substrate to the feedback CPU;

evaluating such audible determination, vertical position and view of the substrate by the feedback CPU; and regulating at least the vertical movement of the abrading tool in response to the evaluation of such audible determination, vertical position and view of the substrate.

35. The method of claim 32 wherein the apparatus further comprises at least a second height sensing device and a feedback CPU and wherein the method further comprises the steps of:

determining the vertical position of the at least one bur just in front of the at least one bur with a first height sensing device;

determining the vertical position of the at least one bur just behind the at least one bur with a second height sensing device;

communicating the vertical positions determined by the first and second height sensing devices to the feedback CPU;

evaluating such vertical positions by the feedback CPU; and regulating at least the vertical movement of the abrading tool in response to the evaluation of such vertical positions.

* * * * *